US005527651A

United States Patent [19]

Hodson

[11] Patent Number: 5,527,651

[45] Date of Patent: Jun. 18, 1996

[54] FIELD EMISSION DEVICE LIGHT SOURCE FOR XEROGRAPHIC PRINTING PROCESS

[75] Inventor: Lester L. Hodson, McKinney, Tex.

[73] Assignee: Texas Instruments Inc., Dallas, Tex.

[21] Appl. No.: 402,573

[22] Filed: Mar. 13, 1995

Related U.S. Application Data

[62] Division of Ser. No. 333,443, Nov. 2, 1994.

[51] Int. Cl.[6] ..... G03G 13/04; G03G 15/04; G03G 13/01

[52] U.S. Cl. ..... 430/54; 430/42; 430/126; 430/139; 355/21; 355/229

[58] Field of Search ..... 430/42, 54, 139, 430/291, 126, 199; 355/229, 21

[56] References Cited

U.S. PATENT DOCUMENTS

| | | | |
|---|---|---|---|
| 3,043,685 | 7/1962 | Rosenthal | 430/54 |
| 4,721,977 | 1/1988 | Fukae | 355/229 |
| 4,818,914 | 4/1989 | Brodie | 315/169.3 |
| 4,841,335 | 6/1989 | Kohyama | 430/42 |
| 4,857,799 | 8/1989 | Spindt et al. | 313/495 |
| 4,927,725 | 5/1990 | Nishide et al. | 430/54 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |

*Primary Examiner*—Richard L. Schilling
*Attorney, Agent, or Firm*—Rose Alyssa Keagy; Richard L. Donaldson

[57] ABSTRACT

A xerographic printing system is constructed using a field emission device 120 as a modulated light source. Alternatively, a lens 122 may be disposed between the field emission device 120 and the photoreceptor drum surface 106. The field emission device 120 may project a single pixel row, or may project multiple pixel rows which provide gray scale capability. The field emission device 120 may also provide color print capability.

4 Claims, 5 Drawing Sheets

FIELD EMISSION DEVICE LIGHT SOURCE FOR XEROGRAPHIC PRINTING PROCESS

This is a division of application Ser. No. 08/333,443, filed Nov. 2, 1994, pending.

TECHNICAL FIELD OF THE INVENTION

The present invention relates generally to printing systems and, more particularly, to such systems and methods using a field emission light source.

BACKGROUND OF THE INVENTION

There are numerous situations where it is important to control light energy and light transmission. For example, in a xerographic reproduction system, such as a printer, digital copier or facsimile machine, light from a source must be modulated into a series of dots (on and off conditions of the light) to form the image which is to be reproduced. The actual reproduction to the final media (typically paper) is accomplished through a light-sensitive photoreceptor in the form of a rotating drum, or belt, onto which the modulated light image has been transmitted. The drum is electrostatically discharged at the place where the light dots have exposed the drum so that charged ink particles called toner, adhere to the drum at those places. This toner is then transferred to the paper to create the final reproduced image.

In common xerographic printer systems, the electrical signals are converted to light images by modulation of the light output of a laser that is in turn rastered across the drum by a rotating polygon mirror. The modulated signals are then applied to the rotating drum. This light modulation systems suffers from the problem that there are a large number of parts which must be in perfect optical alignment. Additionally, IR heating problems arise from the use of a laser light source. Another commonly used light source is the tungsten halogen light bulb.

In attempt to reduce the cost and complexity of such systems and improve print quality, it is desirable to provide a system which will maintain a reduced-heat environment. Accordingly, there is a need in the art for a printing system which generates less heat than today's systems which employ a halogen lamp, a CRT or a laser light source.

There is a further need in the art for such a system in which the light modulation system is a compact system in order to reduce to a minimum the printer size. These problems must be solved while maintaining high reliability through the use of solid state electronics and without establishing the need for complicated light transmission paths.

SUMMARY OF THE INVENTION

A xerographic printing system is constructed using a field emission device (FED) as a modulated light source. Alternatively, a lens may be disposed between the FED and the photoreceptor drum surface. The FED may project a single pixel row, or may project multiple pixel rows which provide gray scale capability. The FED may also provide color print capability.

The use of a FED exposure unit, as disclosed herein, has numerous technical advantages. FED technology consumes less power, and generates less heat than current light source technologies such as the halogen lamp or the CRT. FED technology is also more reliable. The exposure unit of the laser polygon scanner has a large number of pans including a rotating polygon mirror and motor. Conversely, the exposure unit containing the FED contains no moving parts and is therefore more reliable. Another technical advantage is that the FED exposure unit is approximately ¼ the volume of other exposure unit technologies such as CRT systems. Additionally, the FED light source is capable of interfacing to a variety of data and video sources.

A further technical advantage of this exposure unit is that is suitable for high speed and high quality situations. The quality of the printing can be even further enhanced by reducing the spacing between the phosphor stripes of the FED anode.

There are still other technical advantages of the FED exposure unit. The use of a FED light source provides color printing capability. In addition, the FED light source provides a more uniform light intensity than other light sources such as the halogen lamp. Uniform light intensity is critical to a high quality printing process. This is because the quality of the final image is dependent upon the placement of accurate levels of charge on the photoreceptor drum.

BRIEF DESCRIPTION OF THE DRAWINGS

The foregoing features of the present invention may be more fully understood from the following detailed description, read in conjunction with the accompanying drawings, wherein.

DETAILED DESCRIPTION

Figure 1:
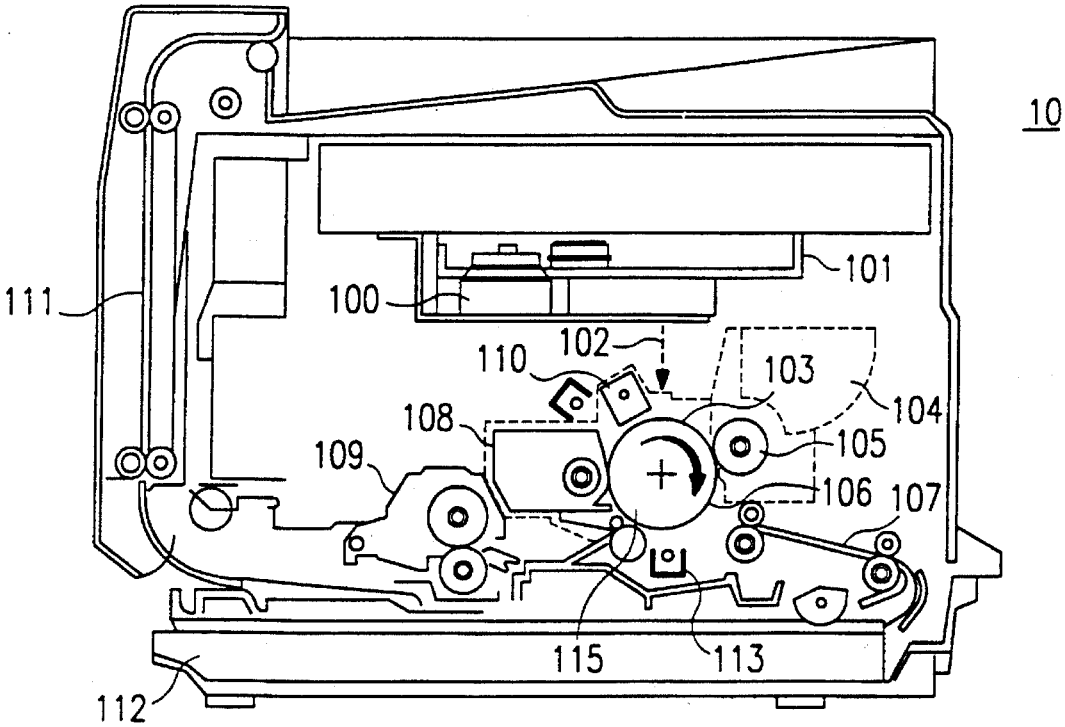
FIG. 1 (PRIOR ART)
FIG. 1 is a prior art xerographic printer.

FIG. 1 shows a prior art xerographic printer 10. As shown, polygon scanner 100 is contained in polygon scanner assembly 101 and positioned above drum surface 106 of photoreceptor drum 115. The laser exit point 102 shows the path of the light ray on its way to the photoreceptor drum surface 106 at pixel line 103. Toner supply 104 is mounted above developer roller 105 which is used in the conventional manner to provide toner to photoreceptor drum surface 106. Toner is applied to the photoreceptor drum surface 106 and adheres to the spots where the modulated light from the laser impacts the drum. Line by line the modulated light places closely spaced dots on drum surface 106 as the drum rotates. Contiguous rows of dot patterns are deposited in order to have a continuous printing process.

Paper 107 shows one path of the paper which would then pass in contact with photoreceptor drum 106 and would subsequently exit the printer via exit path 111. Main corona unit 110 is mounted above the photoreceptor drum surface 106. Fuser and cleaner unit 108 is mounted adjacent to photoreceptor drum 115 to clean the drum on each rotation.

The paper receives the toned image from drum surface 106 at transfer station 113 and moves through fuser unit 109 on its way to the exit path 111. The fuser unit 109 has two rollers which serve in a well known manner to fuse the toner onto the paper stock so that the printed material cannot be easily removed. The paper could be stored in input paper tray 112 prior to presentation to photoreceptor drum surface 106 for printing.

Figure 2:
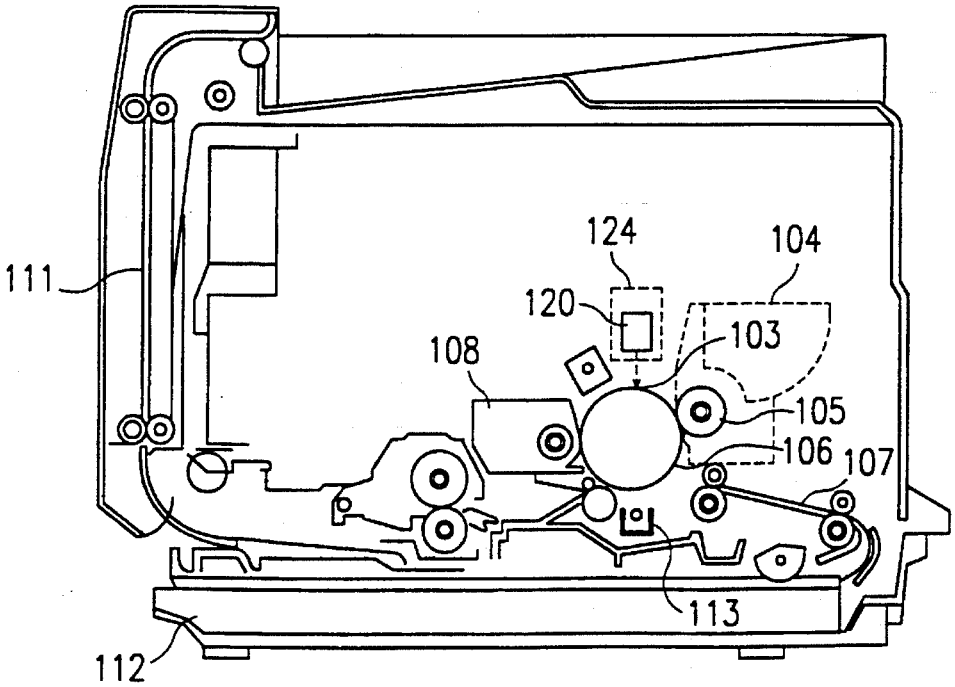
FIG. 2 is a xerographic printer having a FED exposure unit replacing the polygon scanner in accordance with a first embodiment of the present invention.

In FIG. 2 there is one embodiment of the present invention where only the basic parts of the xerographic process such as photoreceptor drum 106, toner supply 104, developer roller 105, cleaner 108 and fuser 109 are shown. All of these parts remain the same. What is different is the optical exposure unit 124 which uses a field emission device (FED) light source 120 described more fully below.

A FED flat panel display arrangement is disclosed in U.S. Pat. No. 4,857,799, "Matrix-Addressed Flat Panel Display," issued Aug. 15, 1989, to Charles A. Spindt et al., incorporated herein by reference. This arrangement includes a matrix array of individually addressable light generating means of the cathodoluminescent type having cathodes combined with luminescing means of the CRT type which reacts to electron bombardment by emitting visible light. Each cathode is itself an array of thin film field emission cathodes on a backing plate, and the luminescing means is provided as a phosphor coating on a transparent face plate which is closely spaced to the cathodes.

The backing plate disclosed in the Spindt et al. ('799) patent includes a large number of vertical conductive stripes which are individually addressable. Each cathode includes a multiplicity of spaced-apart electron emitting tips which project upwardly from the vertical stripes on the backing plate toward the face plate. An electrically conductive gate electrode arrangement is positioned adjacent to the tips to generate and control the electron emission. The gate electrode arrangement comprises a large number of individually addressable, horizontal stripes which are orthogonal to the cathode stripes, and which include apertures through which emitted electrons may pass. The gate electrode stripes are common to a full row of pixels extending across the front face of the backing structure, electrically isolated from the arrangement of cathode stripes. The anode is a thin film of an electrically conductive transparent material, such as indium tin oxide, which covers the interior surface of the face plate. Deposited onto this metal layer is a luminescent material, such as phosphor, that emits light when the anode is bombarded by electrons released from the cathode.

The matrix array of cathodes is activated by addressing the orthogonally related cathodes and gates in a generally conventional matrix-addressing scheme. The appropriate cathodes of the display along a selected stripe, such as along one column, are energized while the remaining cathodes are not energized. Gates of a selected stripe orthogonal to the selected cathode stripe are also energized while the remaining gates are not energized. The result is that the cathodes and gates of a pixel at the intersection of the selected horizonal and vertical stripes will be simultaneously energized, emitting electrons so as to provide the desired pixel display.

Other advances in field emission display technology are disclosed in U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frédéric Clerc. These patents are also incorporated herein by reference.

The Clerc ('820) patent discloses a trichromatic field emission flat panel display having a first substrate comprising the cathode and gate electrodes, and having a second substrate facing the first, including regularly spaced, parallel conductive stripes comprising the anode electrode. These stripes are alternately covered by a first material luminescing in the red, a second material luminescing in the green, and a third material luminescing in the blue. The conductive stripes which are covered by the same luminescent material are electrically interconnected.

Figure 3:
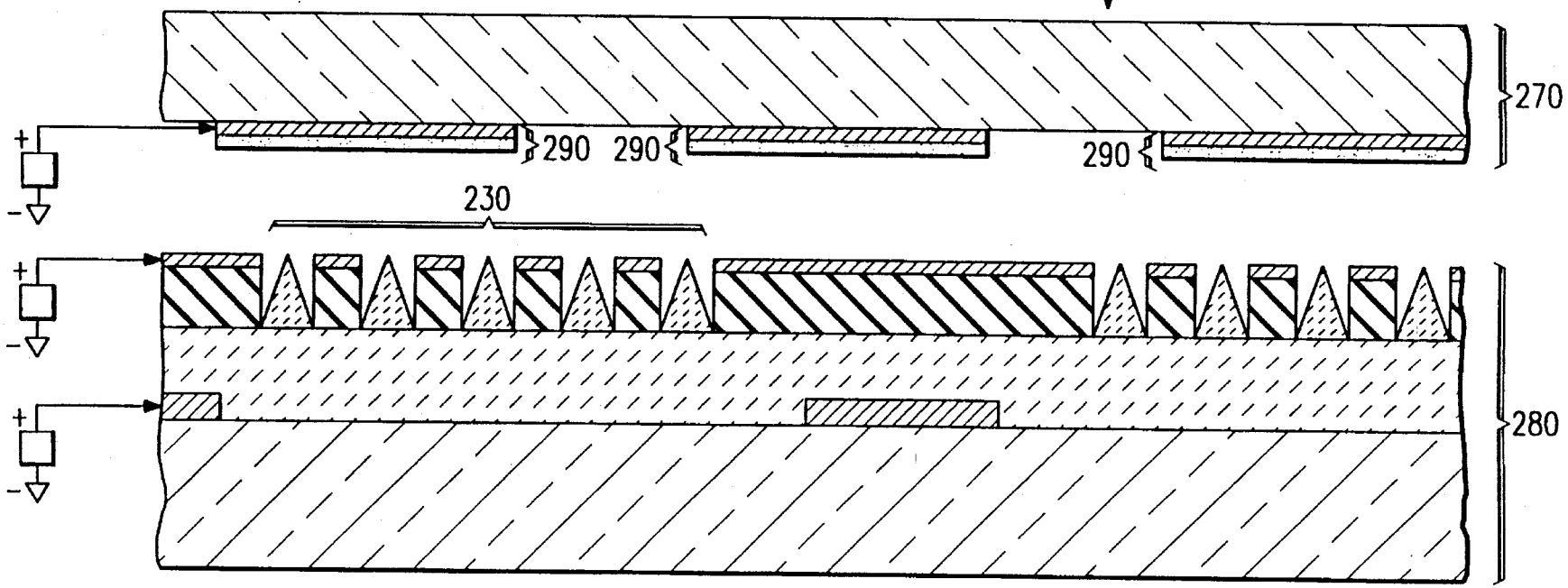
FIG. 3 (PRIOR ART)
FIG. 3 is a prior art cross-sectional view of a portion of a field emission device having color stripes.
Figure 4:
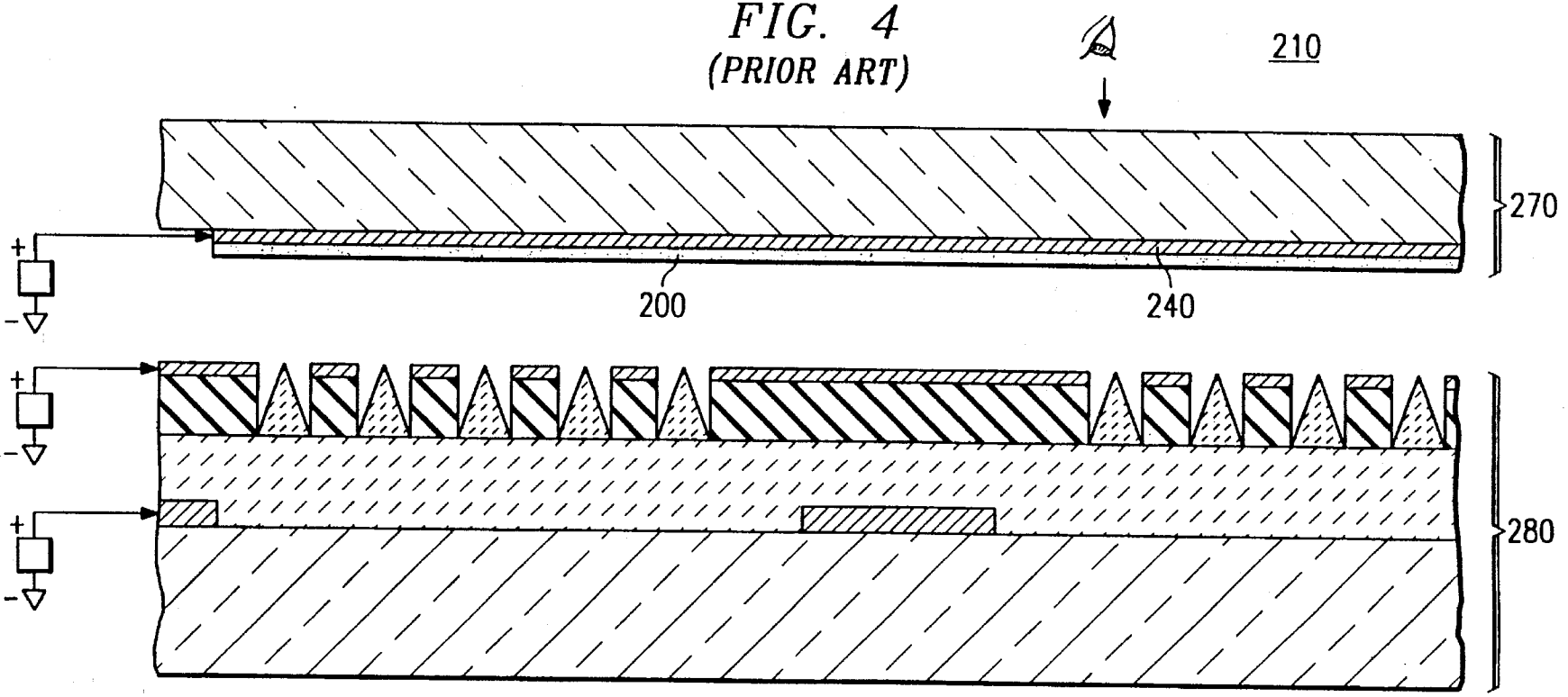
FIG. 4 (PRIOR ART)
FIG. 4 is a prior art cross-sectional view of a portion of a field emission device having a single phosphor layer.

A typical prior art FED color display is shown in FIG. 3. A conventional FED 210 is manufactured by combining the teachings of the Spindt et al. ('799) and Clerc ('820) patents. The typical FED comprises an anode 270, and an emitter 280. The anode 270 has red, green, and blue color phosphor stripes 290. The image created by the phosphor stripes is observed from the anode side which is opposite to the phosphor excitation, as indicated in FIG. 3. Alternatively, a typical prior art monochrome display, shown in FIG. 4, comprises anode 270, emitter 280, and a single phosphor coating 200 deposited over conductive film 240 of anode 270. To create a monochrome image a fixed voltage is applied on anode 270 and the voltage on emitter 280 is modulated to create gray-scale variations. It is to be noted and understood that true scaling information is not intended to be conveyed by the relative sizes and positioning of the elements of anode plate 270 and the elements of emitter plate 280 as depicted in FIGS. 3 and 4. For example, in a typical FED shown in FIG. 3 there are ten sets, or matrixes, of microtips 230 and there are three color stripes 290 per display pixel.

The use of field emission display technology to construct a lamp is disclosed in U.S. Pat. No. 4,818,914, "High Efficiency Lamp," issued 4 Apr. 1989 to Brodie. This patent is incorporated herein by reference.

The process of producing each display frame using a typical trichromatic field emission display 210 includes applying an accelerating potential to the red anode stripes while sequentially addressing the row lines (gate electrodes) with the corresponding red video data for that frame applied to the column lines (cathode electrodes). Next, switching the accelerating potential to the green anode stripes while sequentially addressing the rows lines for a second time with the corresponding green video data for that frame applied to the column lines. Then finally, switching the accelerating potential to the blue anode stripes while sequentially addressing the row lines for a third time with the corresponding blue video data for that frame applied to the column lines. This process is repeated for each display frame.

Returning to FIG. 2, FED light source 120 is generally a standard FED as defined above. However, FED 120 in the preferred embodiment is 2000×1 pixels in size, compared to the standard FED display size of 640×480. This increase in number of pixels per line is required for high resolution, and therefore, high quality xerographic printing. The modulated image of a row of pixel dots from FED 120 is projected onto the surface of photoreceptor drum 106. This projection is in a line at 103 across the photoreceptor drum surface 106. Toner supply 104 will thereafter apply toner to the drum surface 106. The toner adheres to the spots where the modulated light impacts the drum surface 106. Paper 107 will pass under drum 106 and at the transfer station 113 paper 107 will receive the toned image in the well known xerographic process. Line by line, the modulated light places closely spaced dots on drum 106 as the drum rotates. Over time contiguous rows of dot patterns would be deposited under control of FED 120 in order to have a continuing printing process.

Figure 5:
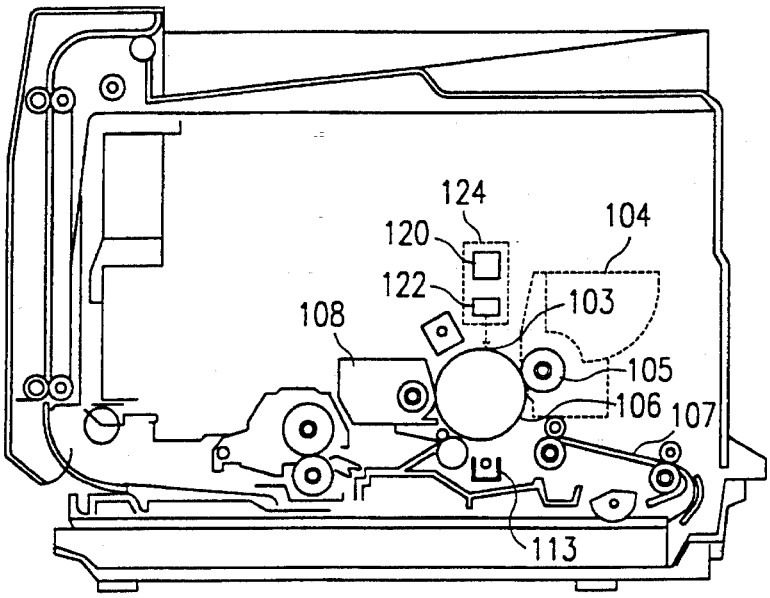
FIG. 5 is a xerographic printer having a FED exposure unit replacing the polygon scanner in accordance with a second embodiment of the present invention.

FIG. 5 shows a second preferred embodiment of the present invention. Disposed between FED 120 and pixel line 103 on drum surface 106 is a lens 122. The lens 122 will provide for a higher resolution pixel image at pixel line 103. The exact resolution of lens 122 is determined by the type of lens chosen. Lens 122 in this embodiment is a SLA-20 manufactured by NSG America Inc. The SLA-20 lens is used here because it requires a lower total conjugate and therefore the printer is a more compact size. The resolution of the image received by drum surface 106 is also influenced by the closeness of the phosphor stripes of the FED anode.

Figure 6:
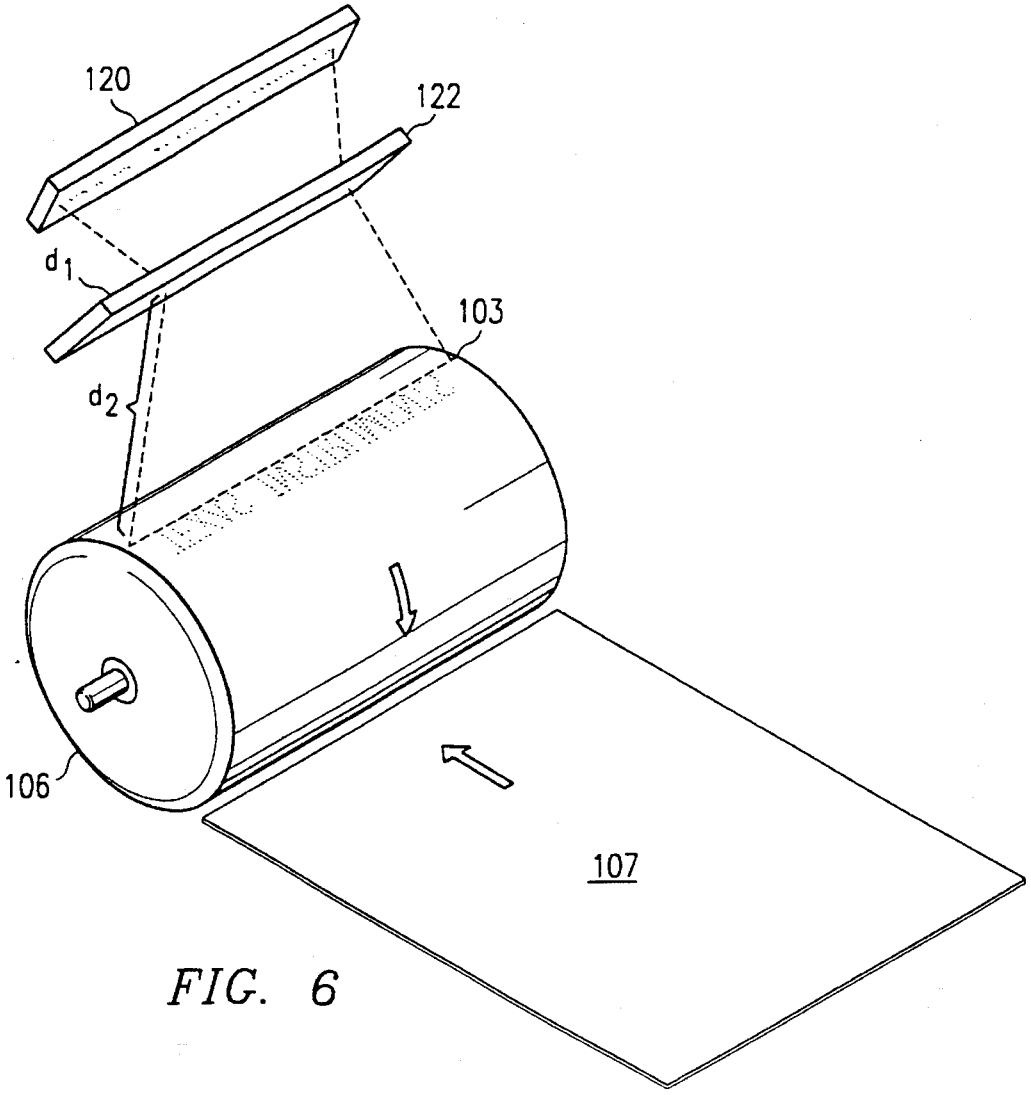
FIGS. 6–7 show the interaction of the FED optic path with a xerographic printing drum in accordance with a first embodiment of the present invention.
Figure 7:
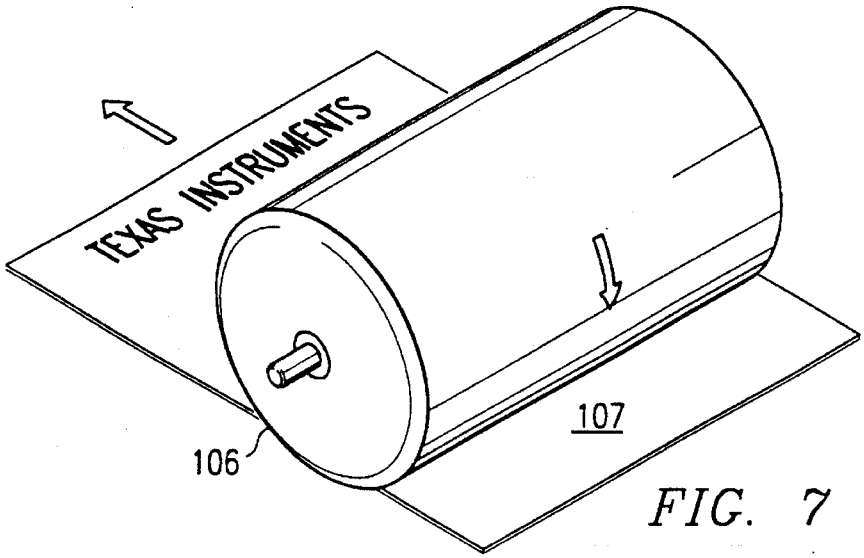

Continuing now in FIG. 6, FED 120 produces a modulated pixel image. This is accomplished by first loading the pixel data into the cathode of the FED 120. After the data is loaded into the cathode, the anode is powered on to approximately 800 volts. The modulated image of pixel dots from FED 120 is focused by the lens 122 onto the surface of xerographic printing drum 106. Using the SLA-20 lens, distance $d_1$ is approximately 4.1 mm and distance $d_2$ is approximately 4.1 mm. The projection is in a line 103 across the surface of the drum 106 and contains one row of the modulated dot pattern which will form the printing on paper 107 which passes under drum 106 in the direction shown. As discussed above, toner is applied to drum surface 106 and adheres to the spots where the modulated light impacts the drum. This toner is then transferred to paper 107 in the well known xerographic process. Line by line, the modulated light places closely spaced dots on drum 81 as the drum rotates. This rotation eventually causes the printing process to take place as shown in FIG. 7. While the drum is shown advancing with no further modulated dot patterns on drum surface 106, this is shown only to make it easy to visualize the process. In fact, in actual practice, contiguous rows of dot patterns would be deposited under control of the exposure unit 124 in order to have a continuing printing process.

Figure 8:
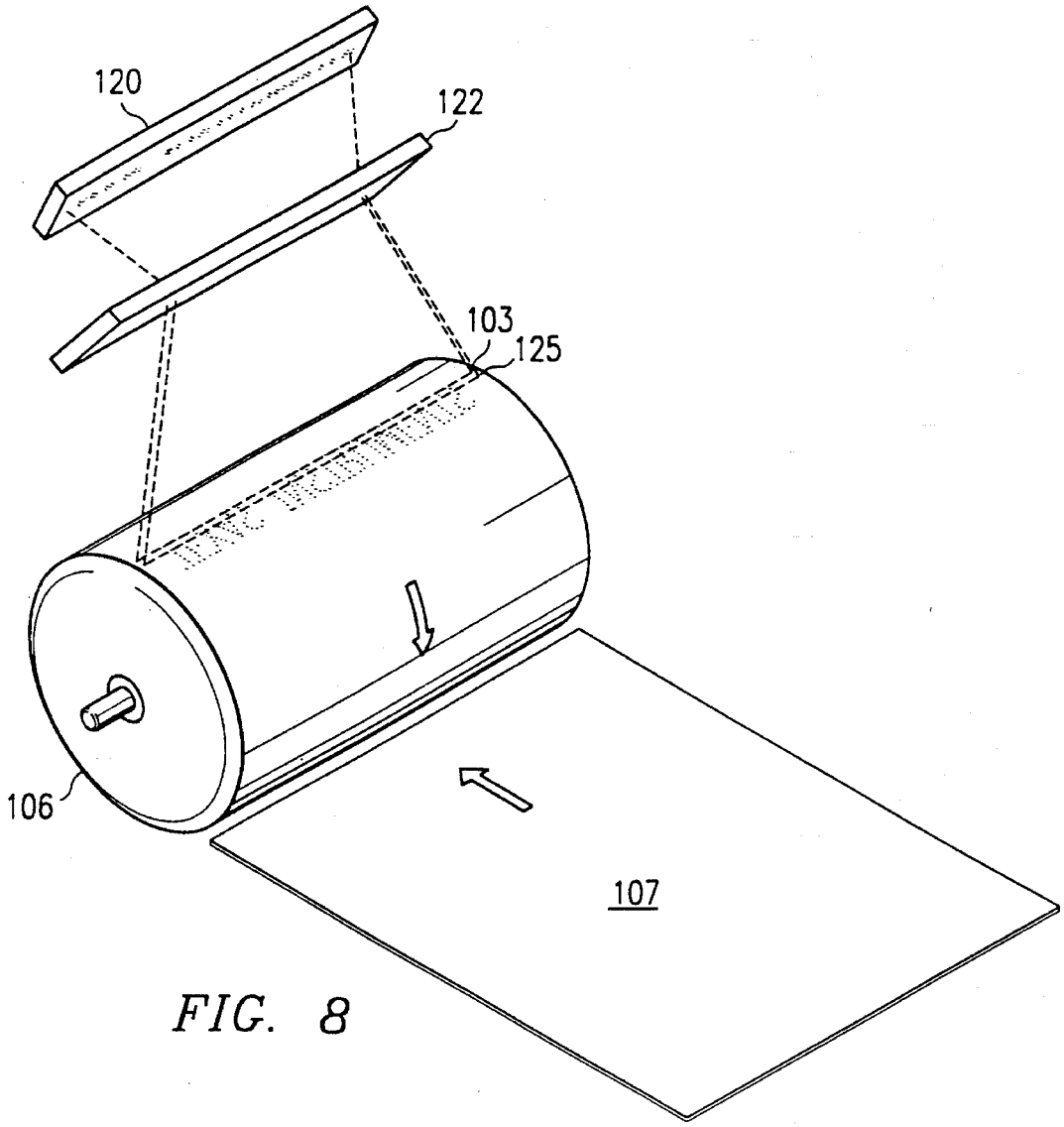
FIG. 8 shows the interaction of the FED optic path with a xerographic printing drum in accordance with another embodiment of the present invention.

In a third embodiment, shown in FIG. 8, at least one additional row of pixels is placed on the drum at one time. This embodiment provides half tones and gray scaling of the image placed on drum surface 106, thereby giving gray scale to the image transferred to paper 107, in the well known TDI (Time Delay and Integrate) technology. With this technique, pixels of a first location are first placed on drum surface 106 at time t. As the drum rotates, selected pixels are exposed at the same first location, line 125, at time t+1. The pixels placed on the drum surface 106 at line 125 may be the same or different than the pixels place at the same first location while at drum location 103 at time t. If a pixel placed on drum surface 106 at line 103 at time t is re-exposed at line 125 at time t+1 then more toner will be attracted to that spot on drum surface 106. The result is that the image placed on the paper 107 will be darker at that location than other locations which were only exposed once, and gray scaling is achieved. Of course, adding a third pixel line to FED 120 will provide even greater gray scale detailing than having two pixel lines. The number of lines of pixels simultaneously projected by FED 120 through lens 122 is limited by the ability of the lens 122 to resolve the pixel images without light divergences.

In yet another embodiment, exposure unit 124 of FIG. 2 or 5 could provide color printing capability. In this embodiment FED 120 is a color FED having red, green, and blue phosphor stripes, as described above. In response to a data signal containing color image data from a host system (not shown) FED 120 first displays the successive pixel rows of the red image during a first pass of paper 107 past transfer station 113. This process is then repeated for the green and blue images. Toner supply 104 would hold red, green and blue toner. Three developer rollers 105 would then be used to place the red, green and blue images onto paper 107 during the three passes of paper 107 through transfer station 113.

Several other variations of the above would be understood by one skilled in the art and are considered to be within the scope of the present invention. For example, the anode of FED 120 could be powered to a higher voltage, such as 10,000 volts. This increased intensity of FED 120 would provide quicker exposure of the drum surface 106. This would allow the rotation speed of the drum to be increased, and thereby facilitate quicker printing speeds.

The use of a FED exposure unit, as disclosed herein, has numerous technical advantages. FED technology consumes less power, and generates less heat than current light source technologies such as the halogen lamp or the CRT. FED technology is also more reliable, the exposure unit of the laser polygon scanner has a large number of parts including a rotating polygon mirror and motor. Conversely, the exposure unit containing the FED, contains no moving parts and is therefore more reliable. Another technical advantage is that the FED exposure unit is approximately ¼ the volume of other exposure unit technologies such as CRT systems. Additionally, the FED light source is capable of interfacing to a variety of data and video sources.

A further technical advantage of this exposure unit is that is suitable for high speed and high quality situations. The quality of the printing can be even further enhanced by reducing the spacing between the phosphor stripes of the FED anode.

There are still other technical advantages of the FED exposure unit. The use of a FED as a light source also provides the technical advantage of color printing capability. In addition, the FED light source provides a more uniform light intensity than other light sources such as the halogen lamp. Uniform light intensity is critical to a high quality printing process. This is because the quality of the final image is dependent upon the placement of accurate levels of charge on the photoreceptor drum.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A xerographic printing method having an exposure process and a contact reproductive process, said contact reproductive process operative in response to presentation of light images for representing said light images on a print transfer medium and for subsequently transferring said represented image to a final printed surface, said printing method comprising the steps of:

providing said light image by energizing selected pixels of a cathode and energizing an anode of a field emission device;

exposing said print transfer medium to said light image;

providing toner such that said toner adheres to said exposed image on said print transfer medium; and transferring said toner adhering to said print transfer medium to said final printed surface.

2. The method set forth in claim 1 wherein said light image is modulated in response to an off/on data signal received from a data processor.

3. The method set forth in claim 1 further comprising the step of passing said light image through at least one lens to focus light from said field emission device onto said print transfer medium.

4. A method of creating gray scale on a printed medium using a xerographic process comprising the steps of:

presenting a first row of field emission device modulated light as individual pixels to a first location of a rotating photoreceptor by energizing selected pixels of a cathode and energizing an anode; and presenting at least one subsequent row of field emission device modulated light as individual pixels to said first location by energizing selected pixels of a cathode and energizing an anode.

* * * * *